US006571586B1

(12) United States Patent
Ritson et al.

(10) Patent No.: US 6,571,586 B1
(45) Date of Patent: Jun. 3, 2003

(54) PORTABLE WRINGER

(75) Inventors: Michael Ritson, Chateau Loire, Mont a la Brune, St. Brelade, Jersey (GB), JE3 8FL; Maurice Willis, The Willows, New Road, Digswell, Herts (GB), AL6 0AQ; Ronald Hickman, Jersey (GB)

(73) Assignees: Michael Ritson, Jersey (GB); Maurice Willis, Herts (GB)

( * ) Notice: Subject to any disclaimer, the term of this patent is extended or adjusted under 35 U.S.C. 154(b) by 0 days.

(21) Appl. No.: 09/550,485

(22) Filed: Apr. 14, 2000

Related U.S. Application Data

(63) Continuation of application No. PCT/GB98/03111, filed on Oct. 16, 1998.

(30) Foreign Application Priority Data

Oct. 16, 1997 (GB) ..... 9721938

(51) Int. Cl.[7] ..... D06F 45/24; D06F 45/26

(52) U.S. Cl. ..... 68/239; 68/257; 68/264; 68/270; 68/271; 68/273

(58) Field of Search ..... 68/125, 126, 238, 68/239, 257, 264, 270, 271, 272, 273, 274; 15/262; 100/155 R, 171, 176; 74/17

(56) References Cited

U.S. PATENT DOCUMENTS

| | | | | | |
|---|---|---|---|---|---|
| 1,538,511 | A | * | 5/1925 | Burkett | 68/270 |
| 2,207,215 | A | * | 7/1940 | Clapper et al. | 68/264 X |
| 2,409,595 | A | * | 10/1946 | Shield | 68/271 X |
| 2,578,417 | A | * | 12/1951 | Gabrielson | 68/271 X |
| 2,677,951 | A | * | 5/1954 | Haines et al. | 68/271 X |

FOREIGN PATENT DOCUMENTS

| | | |
|---|---|---|
| AU | 249570 | * 2/1964 |
| EP | 0 694 898 | 1/1996 |
| FR | 2 571 391 | 4/1986 |
| JP | 62268751 | 11/1987 |

* cited by examiner

*Primary Examiner*—Philip R. Coe
(74) *Attorney, Agent, or Firm*—Patterson, Thuente, Skaar & Christensen, P.A.

(57) ABSTRACT

A portable wringer 11 for a chamois leather comprises a support structure 12, and a pair of rollers 13,14 driven by a crank handle 15. The support structure 12 carries a suction device 18.

28 Claims, 5 Drawing Sheets

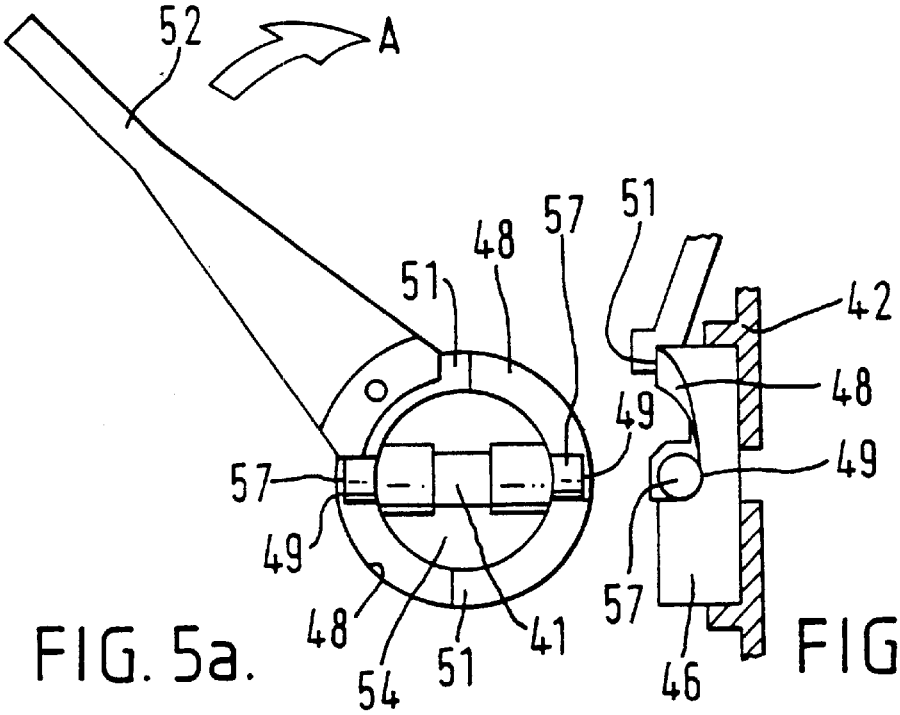
FIG. 5a.
FIG. 5b.
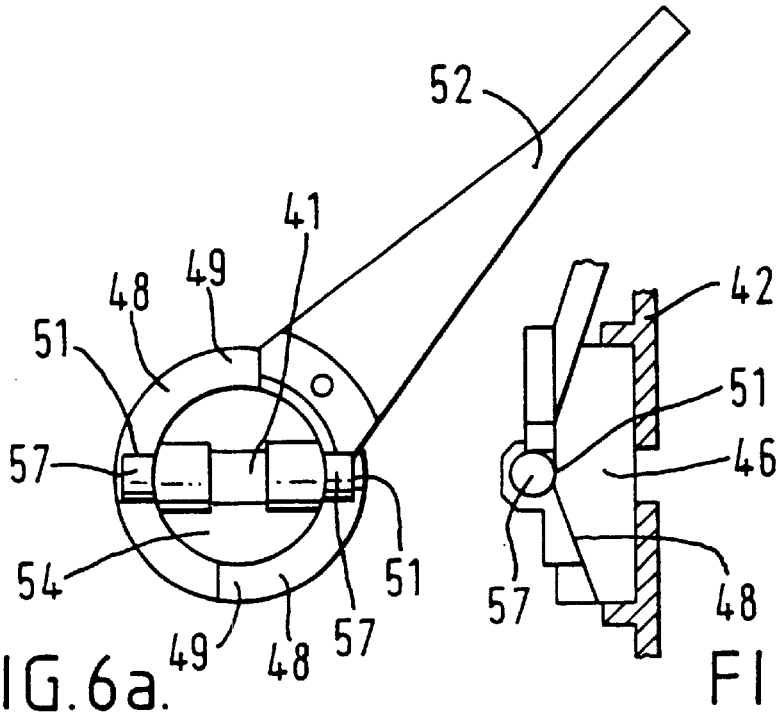
FIG.6a.
FIG.6B.

PORTABLE WRINGER

This is a Continuation of application Ser. No. PCT/GB98/03111, filed Oct. 16, 1998.

The present invention relates to a portable wringer and more particularly to a portable wringer for removing liquid from a wet leather, cloth or piece of fabric. It is especially intended for wringing water out of chamois leathers used for washing automobiles and other vehicles, but is not restricted to this purpose.

When washing water is removed from a vehicle using a leather, the leather has to be wrung out. When the operation is carried out by hand, it is difficult to obtain an even degree of dryness. At the same time it can cause chaffing of the hands and the leather can become stretched. Additionally, the wrung-out water can find its way to the clothes or feet of the user.

Clearly, therefore it would be advantageous to employ a mangle or wringer. However a fixed mangle would be inconvenient since it would necessarily be located at a distance from at least parts of the vehicle being washed and this would require the person washing the vehicle to walk back and forth to the mangle. Portable mangles have therefore been proposed and one such device is designed to clip over the window of vehicles for example as shown in FR-2571391. However, this device suffers the disadvantage that it can not be sufficiently rigidly attached to the window so that operation of the mangle causes the device to wobble. Also, the integrity of the window seal is compromised leading to a risk that water might enter the vehicle and mark the upholstery. Furthermore, the device is impractical if the vehicle is on a gradient since the device itself will be similarly inclined.

What is required, therefore, is a portable wringer that can be firmly and reliably attached to a vehicle without exposing the interior of the vehicle to the risk of leaks.

According to the invention, there is provided a portable wringer for removing liquid from a wet leather, cloth or piece of fabric, which comprises: a support structure; a pair of rollers rotatably mounted on the support structure; means for urging the rollers together towards a position in which the surfaces of the rollers would make mutual contact along their respective lengths; means for rotating at least one of the rollers; and a suction means attached to the support structure, the suction means being arranged to adhere to a smooth surface. A leather can therefore be passed between the rollers as they are rotated. The use of suction means enables the device to be attached to a vehicle window, without affecting the seal of the window.

Preferably, the rollers are cylindrical and are arranged with their axes in parallel and are preferably urged into mutual contact. They may comprise a rigid core coated with a layer of resilient material and preferably have spindles at each end, each spindle being supported in a bearing, the bearings being urged together by resilient means.

Preferably, one of the rollers is operatively connected to a crank handle, whereby the roller can be manually rotated. The other roller may then be free-running and will be driven by frictional contact with the roller which is manually rotated. This would, of course, normally occur via the leather which would be passed between the rollers. Preferably, the rollers are arranged to lie one above the other in use and the crank handle is operatively connected to the lower roller.

Alternatively, the rollers may be connected by gear arrangement or a chain or belt so that both rollers are driven. It is even possible for one or both rollers to be motor-driven for example using battery power. The battery may then be the vehicle battery.

Preferably, the device includes liquid catchment means arranged to receive liquid expelled from the leather by the rollers and an enclosure arranged to receive the leather as it leaves the rollers, in use. This minimises the risk of the liquid removed from the leather soiling the clothes or footwear of the user. It also ensures that the leather itself does not fall to the ground and become fouled with mud, dirt or grit. Preferably the liquid catchment means comprises a tray, the tray having one or more liquid discharge ports. Preferably, any discharge port is arranged to discharge the liquid in use in a direction away from the user. Alternatively, the liquid catchment means would comprise a temporary storage container for the liquid expelled from the leather; the container could be emptied periodically.

Preferably, the enclosure for the leather is located above the liquid catchment means and may include a deflector arranged to direct the leather away from the liquid catchment means in use. Preferably, the device includes a scraper located adjacent the upper and/or lower roller and arranged to lift a leather adhering to the surface of the respective roller. In a preferred embodiment, the scraper is located adjacent the upper roller and takes the form of a brush.

Preferably, the suction means comprises a single suction device though there may be a plurality. It preferably comprises a flexible disc having a central portion which is movable rearwardly from the plane of the disc in a direction towards the rollers by means of a cam arrangement. Preferably, the camming action of the cam arrangement is activated by a lever movable in a plane generally parallel to the plane of the disc. Preferably the lever swings in an arc above the level of the cam arrangement, the enclosure and the liquid catchment means, in use. Preferably, the cam arrangement has a cover extending into the enclosure, the cover being arranged to deflect the leather upwards as it leaves the rollers in use. Preferably, the wringer includes a manual engagement area at a position opposite to the suction means. Preferably, the manual engagement area is positioned opposite the centre of the suction device.

In a preferred embodiment, the suction means comprises: a flexible disc; a support member having a concave portion facing the disc; a camming arrangement on the opposite side of the support member to the disc; and a connecting member passing through the support member and connecting the disc to the camming arrangement, whereby operation of the camming arrangement moves the connecting member and draws the central area of the disc into the concave portion of the support member; and in which the camming arrangement includes first and second cam members which have engaging cam surfaces, the first cam member being movable in an arcuate path in a plane generally parallel to the plane of the disc.

This construction eliminates the need for any operative components in the area behind the camming mechanism, though this is not strictly essential and other arrangements of suction devices may be employed.

Preferably, the disc is made of rubber or a plastics material. Preferably the support member is in the form of a rigid circular cup of metal or plastics whose rim engages the rear surface of the disc and whose diameter is smaller than the diameter of the disc. Thus, when the central area of the disc is drawn into the cup, the protruding outer periphery of the disc maintains contact with the surface of the article which is to be engaged by the suction device, and permits the suction device to adhere positively not only to flat surfaces but to curved surfaces also. The device is even applicable to surfaces which are curved in more than one direction, for example vehicle windows.

Preferably, the connecting member is a rod which is attached to the disc. Preferably, the camming arrangement includes an operating lever connected to and extending generally radially from the first cam member, whereby movement of the lever causes the first cam member to follow its arcuate path. Conveniently, the first cam member has an arcuate cam profile defining its cam surface while the second cam member is a cam follower and is connected to the connecting member. Alternatively, the first cam member may constitute the cam follower and the second cam member may define a stationary profiled cam surface.

Preferably, the connecting member is a square cross-section rod which passes through a correspondingly square shaped hole in the support member, and which is rigidly attached to the disc at one end, and which is non-rotatably attached to the second cam member. Cross-sectional shapes other than square may be used, though if the rod is to be prevented from rotating, a round cross-section is preferably avoided.

Preferably, the arcuate cam profile of the first cam member is coaxial with and extends about the rod, whereby an arcuate movement of the handle causes the arcuate cam profile to follow its arcuate path which in turn causes the cam follower to move in the axial direction without any rotation, thereby drawing the central area of the disc into the concave portion of the support member. In a preferred embodiment, the arcuate cam profile comprises a pair of similar ramps following part circular paths in the same sense and at the same radius, the paths extending between a low position and a high position, and in which the second cam member comprises a pair of bosses which constitute the cam follower, attached to a common base, the base being non-rotatably attached to the rod by means of a pin passing through both the rod an the base.

Thus, when the disc is in a relaxed condition, it is slightly spaced from the support cup and the bosses lie on the ramps at the low positions. As the lever is moved through its arc, the first cam member rotates with it, and the ramps follow their circular path. The bosses which are rotationally fixed, travel along their respective ramps from the low position to the high position and in so doing move the rod axially rearwards. This in turn draws the central area of the disc into the cup, so tending to form a vacuum between the disc and any smooth surface with which the disc may be in contact. The vacuum is then released by reversing the operation.

The suction means may include a cover over the camming arrangement, which may be detachably connected to the first camming member. The device may also include a compression spring acting between the rear of the disc and the inside of the support cup, the spring acting to bias the disc away from the support member.

Preferably, the surface of the support member which engages the disc is provided with one or more protuberances, the protuberances being arranged to deform the resilient material of the disc on engagement, thereby positively preventing any significant relative rotational movement between the disc and the support member. This is a very significant feature, because it is important that the wringer should be prevented from tilting or rotating to one side or the other.

The disc preferably has at its centre a rounded protrusion which serves several purposes. Firstly, when the suction device is offered up to a rigid surface to which it is to be attached, moderate pressure applied by the operator's hand causes the protrusion to cause an initial slight dishing of the disc as the disc bears against the support member on an annular contact ring inboard of the extreme periphery of the disc. Further pressure causes the disc to be seated against the rigid surface to which it is to be attached. This seating may occur at the periphery of the disc (especially in the event of its meeting a convex surface) or in line between the support member and the rigid surface (especially if meeting a flat or flatter surface). The resultant contact of the disc at or near its periphery throughout 360°, plus the slight displacement (hollowing) of the "rubber" disc, causes a small amount of air to be expelled resulting in a relatively negative air pressure between the disc and the surface. This minimal negative air pressure is however not sufficient to do more than seal the disc onto a flat or slightly curved rigid planar surface. With the initial sealing having been effected, however, when the centre of the disc is drawn back by operation of the lever, the negative air pressure will increase.

A second purpose of the protrusion is to avoid what may be termed "phantom suction" such as may be experienced when the device is laid at rest on a flat surface.

A third purpose of the protrusion is to assist in removal of the device. If the protrusion were not present, there would be a potential that after reversing the action of the lever, some adhesion and/or residual suction might develop between the rubber disc and the rigid surface to which it was attached, and the device might stay adhering for a few second and then fall off. However, the protrusion helps to break the residual adhesion, so that when the lever is reversed, the device will detach under gravity into the control of the operator.

Preferably, the support structure comprises a pair of side walls, a base and an end wall, and in which the end wall carries the suction means, the sidewalls and base extend rearwards from the end wall in a direction towards the rollers, and the rollers extend between the side walls at a position spaced from the end wall. There may also be a cover partly surrounding the upper roller. Preferably, the cover constitutes optionally together with the upper roller itself, a carrying handle for the wringer. Preferably, the manual engagement area is constituted by a transverse wall portion located below the level of the cover.

The invention may be carried into practice in various ways and one embodiment will now be described by way of example with reference to the accompanying drawings, in which.

Figure 7:
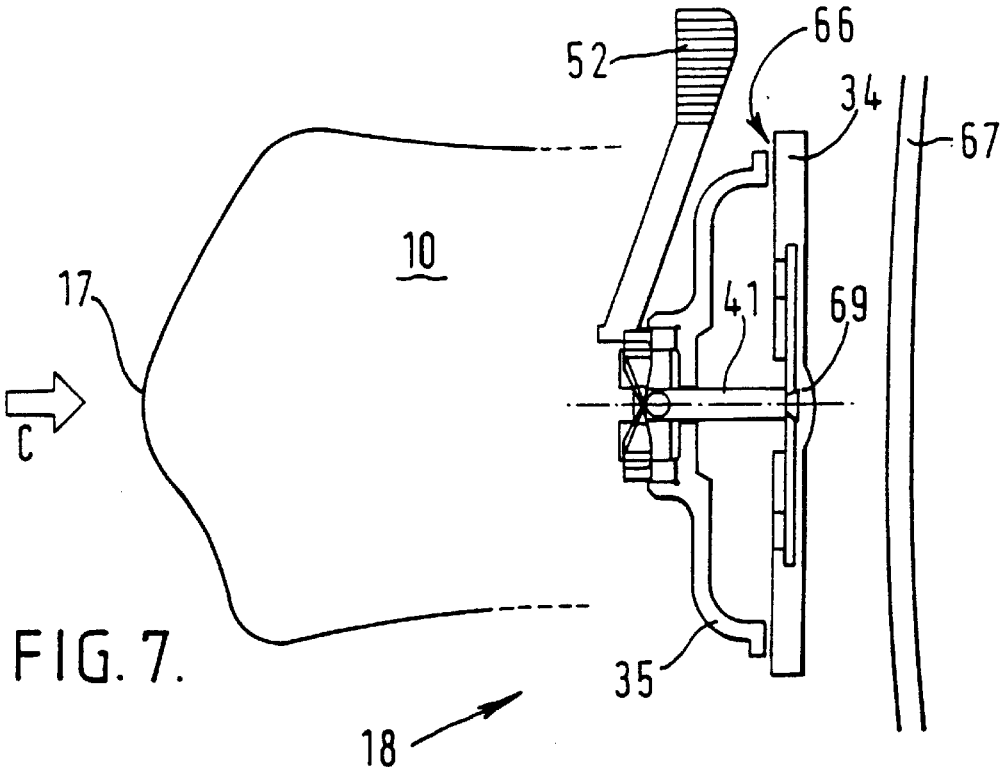
Figure 8:
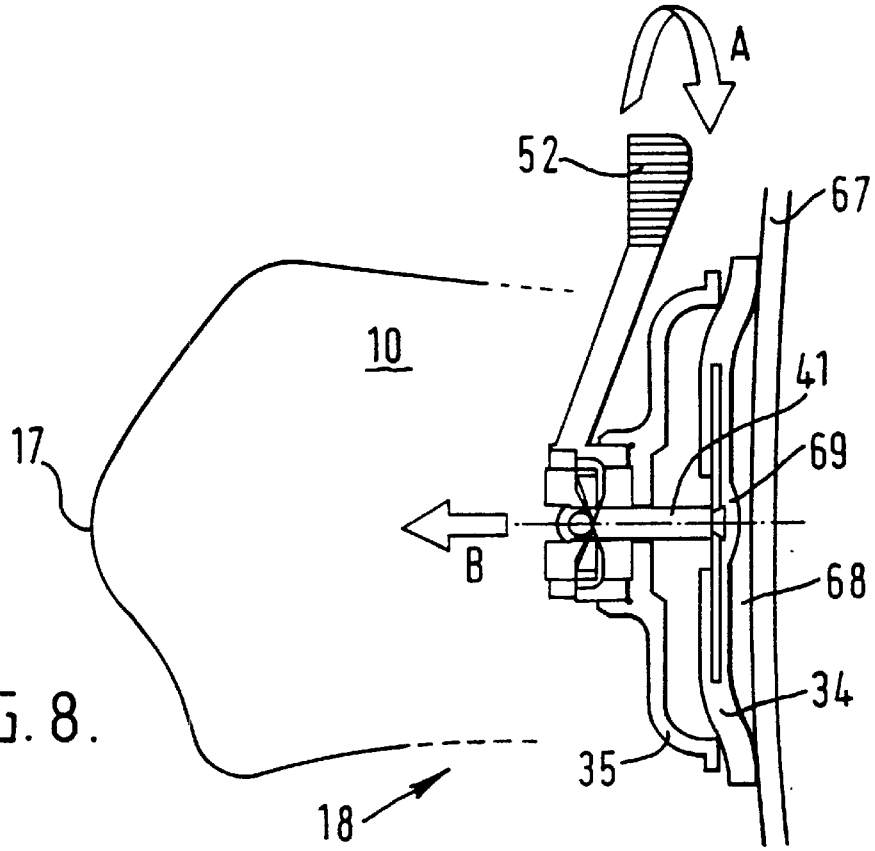

FIGS. 5*a* and 5*b* are a rear view and side view of the cam members in the relaxed or non-activated position;

FIGS. 6*a* and 6*b* are views similar to FIGS. 5*a* and 5*b* but in the activated position;

FIG. 7 is a vertical section through the suction device prior to activation; and FIG. 8 is a view similar to FIG. 7 but after activation and attachment to a surface.

Figure 1:
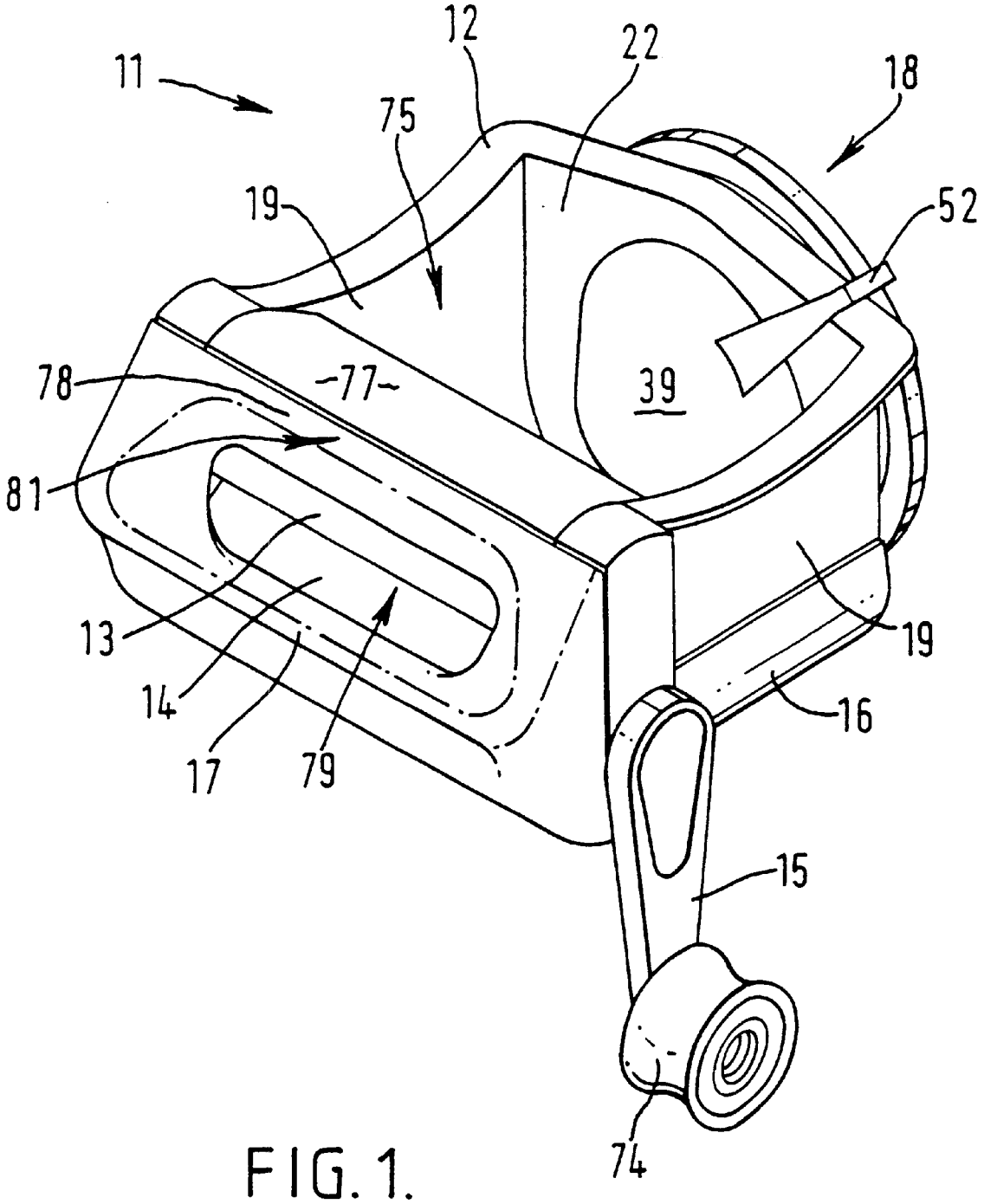
FIG. 1 is a perspective view of a portable wringer in accordance with the invention.
Figure 2:
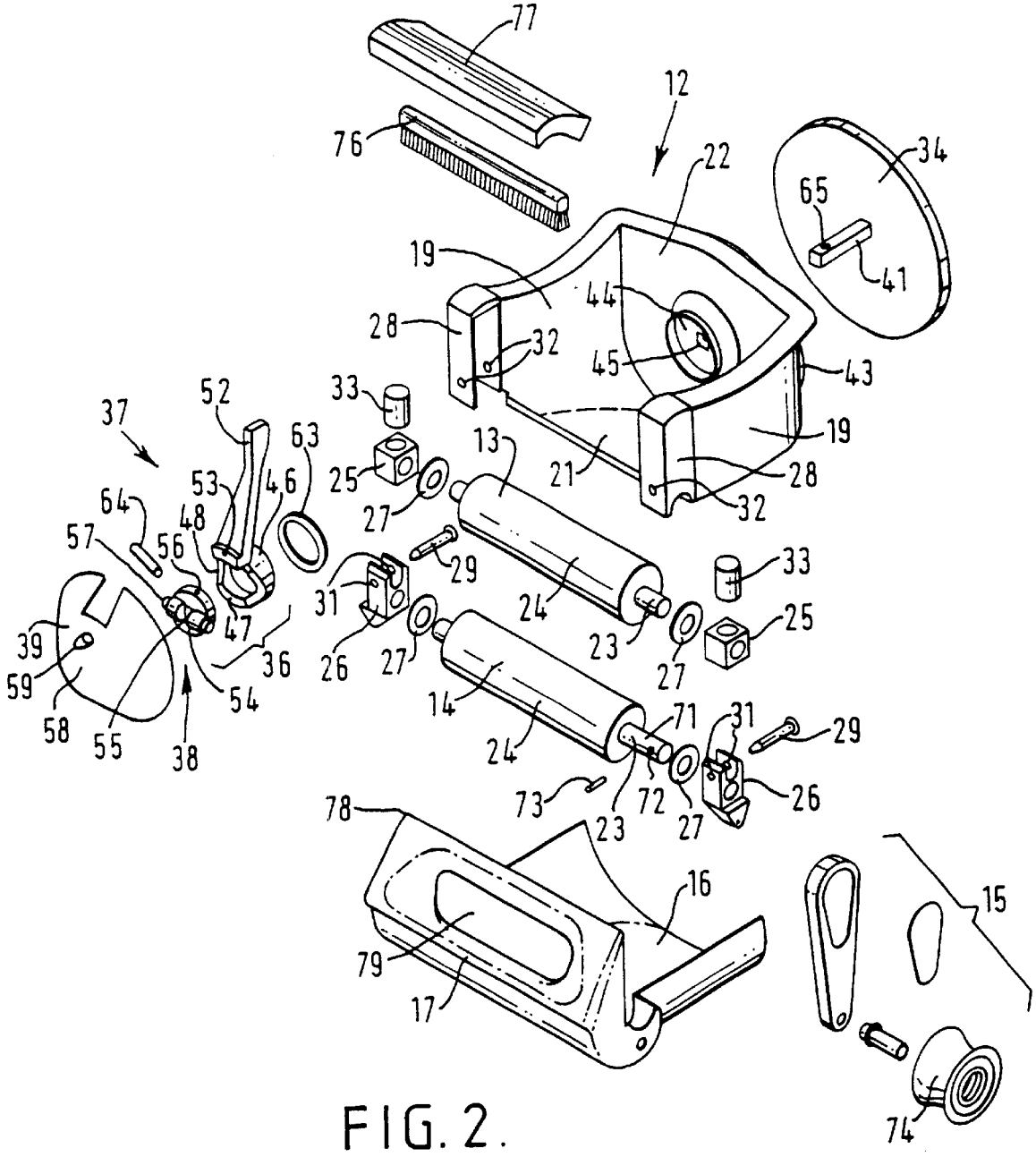
FIG. 2 is an exploded perspective view of the wringer of FIG. 1.

Referring to FIGS. 1 and 2, the portable wringer 11 comprises a support structure 12, a pair of rollers 13,14, a crank handle 15, liquid catchment tray 16, a manual engagement portion 17 and a suction device 18. The support structure 12 comprises a pair of side walls 19, a base 21 and an end wall 22. The end wall 22 carries the suction device 18.

The rollers 13,14 each comprise a metal shaft 23 10 mm in diameter and a 10 mm thick layer of rubber 24, giving an overall diameter of 30 mm. The rubber has a Shore hardness of 60/65. The rollers 13,14 are mounted one above the other in respective bearing blocks 25,26. The shafts 13 are received by the bearing blocks 25,26 via washers 27. The bearing blocks 25,26 are received in two housings 28, one located at the rear end of each side wall 19. The housings 19 are closed at their upper ends.

The lower bearing blocks 26 are located in the housings 28 by means of pins 29 which pass through corresponding holes 31,32 in the lower bearing blocks 26 and housings 28, respectively. The upper bearing blocks 25 are urged downwardly by a pair of spring members 33 made from a resilient polyurethane material having a Shore hardness of 85/95. The spring members 33 act between the upper surfaces of the housing 28 and the upper bearing blocks 25 and in this way, they urge the surfaces of the two rollers 13,14 into frictional contact.

The manual engagement portion 17 is at a level which is slightly above the nip between the rollers 13,14, and extends rearwardly a little further than any other part of the wringer 11.

The suction device 18 comprises a flexible rubber disc 34, a rigid support cup 35 attached to the support structure 12, a camming mechanism 36 including a first cam member 37 and a second cam member 38, and a cover 39. The disc 34 is circular and has a square section metal rod 41 protruding rearwards from its centre. The rod 41 is fixed to a rigid plate (not shown) which is embedded in the disc 34. The front surface of the rigid plate is fixed to the disc 34, which the rear surface of the rigid plate, from which the rod 41 extends, is not. This allows relative movement between the material of the disc 34 and the rigid plate which is important when the device is activated and the disc 34 adopts its concave position.

The support cup 35 has a circular rear wall 42 and a peripheral collar 43 but has a smaller diameter than the disc 34. It has a circular recess 44 in the rear wall 42, and a square hole 45 in the recess 44.

The first cam member 37 is a generally cylindrical member 46 having a slightly smaller diameter than the recess 44. The rear circular rim 47 of the member 46 defines a cam surface which comprises two ramps 48, each extending in the same sense (anti-clockwise in FIG. 5) from a low position 49 to a high position 51. Each ramp 48 extends through an arc of about 90°. A lever 52 extends radially from the cylindrical member 46 and has a tapped hole 53 at its base.

The second cam member 38 comprises a thick circular disc 54 with a square central hole 55. A bore 56 extends from one side of the disc 54 through to the other side, notionally extending through the square hole 55. A circular boss 57 protrudes radially outwards from each side of the disc 54. The diameter of the disc 54 is slightly smaller than the internal diameter of the cylindrical member 46.

The cover 39 is conical with a rounded apex and a slot 58 in its periphery. It also has a countersunk hole 59 near the rounded apex.

Figure 3:
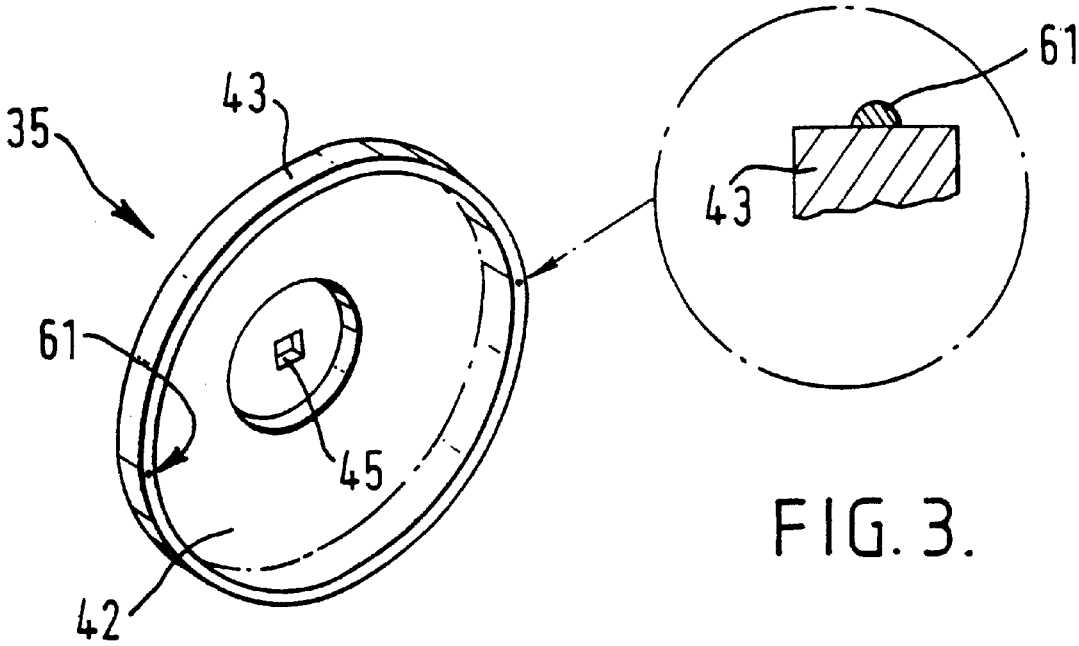
FIG. 3 is a perspective view of the support cup from the front with an enlarged detail.

Referring now to FIG. 3, the front edge of the collar 43 of the support cup 35 has a pair of diametrically opposite studs 61. The studs 61 face towards the disc 34.

When fully assembled, the rod 41 on the disc 34 passes through the square hole 45 in the support cup 35 then on to the cam arrangement 36. The cylindrical member 46 of the first cam member 37 fits into the recess 44 in the support cup 35 with a washer 63 spaced between the components. The rod 41 is located in the square hole 55 in the disc 54 and is held in position by a pin 64 which is inserted into the bore 56 and passes through a hole 65 in the rod 41.

Figure 4:
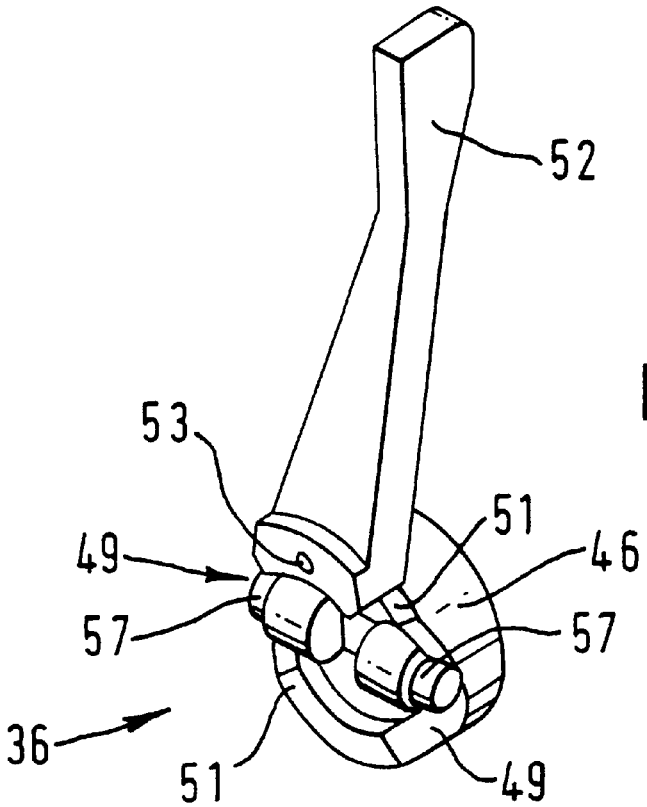
FIG. 4 is a perspective view of the two cam members in engagement.

The disc 54 fits within the cylindrical member 46 (as shown in FIG. 4). The circular bosses 57 lie on the ramps 48 and are movable between the respective low positions 49 and high positions 51. The dimensions of the components and the position of the hole 65 are arranged so that when the device is assembled, with the bosses 48 at the low positions 49 the disc 34 is spaced from the rim of the support cup 35 by a small distance 66 (as shown in FIG. 7), the spacing being maintained evenly by the optional spring 62.

The cover 39 is attached by means of a screw or bolt (not shown) which is inserted into the hole 53 in the first cam member 37 via the countersunk hole 59.

Activation of the device will be described with reference to FIGS. 5 to 8. When the device is to be activated, the lever 52 is moved from the position shown in FIGS. 5*a*, 5*b* and 7 to that shown in FIGS. 6*a*, 6*b* and 8 (arrow A). In so doing, the first cam member 37 is rotated through about 90°, about the axis of the rod 41. The second cam member 38 is restrained from rotation by the square sectioned rod 41 which is located in the square hole 55 and which is itself held against rotation by the square hole in the cup support 35. The bosses 57 are therefore constrained to follow the ramps 48 as they move through their respective arcs to the position shown most clearly in FIGS. 6*a* and 6*b*. In following the ramps 48, the bosses 57 move axially rearwards (to the left in FIGS. 5*b* and 6*b*), thereby moving the second cam member 38 itself rearwards. This takes with it the rod 41 (arrow B).

As the rod 41 moves rearwards, it draws the central part of the flexible disc 34 into the support cup 35. If, prior to this operation, the disc 34 is presented (arrow C) to a smooth surface, such as a curved window 67 as shown in FIGS. 7 and 8, the drawing-in of the central part of the disc 34 initially brings the periphery of the disc 34 into contact with the window. Continued operation of the lever 52 moves the rod 41 and the central part of the disc 34 away from the window, causing a vacuum in space created 68. Atmospheric pressure then holds the suction device 33 in place on the window 67 until the operation is reversed.

In order to assist in locating the disc 34 initially against the window 67, the disc 34 has a rounded protrusion 69. As the protrusion 69 is brought into contact with a surface, it is pushed inwards and so starts the sealing operation. It also assists in breaking the suction when the device is de-activated and helps to hold the device in position when the vacuum is released.

In order to prevent any small relative rotational movement between the disc 34 and the support cup 35, the studs 61 shown in FIG. 3 are provided. When the front rim of the support cup 35 is brought into contact with the disc 34, the studs 71 dig into the resilient material of the disc 34. This engagement positively prevents any relative rotational movement between the disc 34 and the support cup 35.

It will be appreciated that the flexibility of the disc 34 together with the depth of the concavity of the support cup 35 and the relative diameters of the disc 34 and support cup 35 enable the suction device to be used effectively not only on flat surfaces but also on surfaces which are curved in one or more senses.

Thus, the wringer can be securely attached to the window of a vehicle using the suction device 18. The position of the manual engagement portion 17 over the centre of the suction device 18 ensures a positive initial contact and an accurate engagement between the disc 34 and the window, as initial manual pressure from the palm of the hand is applied to the manual engagement portion 17.

Reverting to FIGS. 1 and 2, one end 71 of the shaft 23 of the lower roller 14 extends out beyond its bearing block 26 and is formed with a bore 72. This protruding end 71 is received by the crank handle 15 and is located by means of a pin 73. Thus, as the crank handle 15 is rotated, it rotates the lower roller 14 which in turn rotates the upper roller 13 through mutual frictional contact.

The dimensions of the side walls 19 and the crank handle 15 are arranged to provide sufficient clearance when the device is in use between the knob 74 of the crank handle and any surface to which the device is attached. In order to assist in achieving this situation, the knob 74 has a concave profile which readily receives the forefinger of a user.

In use, a leather is placed in the nip between the rollers 13,14 and the crank handle 15 is turned manually, with the forefinger of the user wrapped around the knob 74. The fact that the manual engagement portion 17 is above the nip means that the leather is inclined downwards to the rollers 13,14 as it passes over the manual engagement portion 17. This ensures that expelled liquid does not run back along the leather, but remains at the rollers 13,14 and drains down on to the catchment tray 16. Thereafter, the liquid drains over the edge of the tray which is beneath the suction device 18. The edge of the tray 16 protrudes to a position which is very close to the window of the vehicle and so the expelled liquid pours on to the window and down to the door sill. This minimises the risk of splashing. The tray 16 is contoured to divert the liquid to a single stream, though it may be arranged to divert the liquid to each side.

The fact that the manual engagement portion 17 is effectively the rearmost part of the device enables a wet leather to hang free from the manual engagement portion 17. There is therefore little drag on the leather and no snagging as it is drawn through the rollers 13,14.

The leather, as it passes through the rollers 13,14, is diverted upwards, away from the expelled liquid, by the domed shape of the cover 39. It is then received in the enclosure 75 formed by the sidewalls 19, the base 21 and the end wall 22 and can be easily retrieved.

In order to ensure that the leather does not adhere to the upper roller 13, a scraper brush 76 is provided in the upper part of the enclosure 75. The brush 76 lightly contacts the upper roller 13 and lifts off the leather if it should be wrapped around the surface of the roller 13. There could also be provided a second scraper brush (not shown) associated with the lower roller 14, however, tests suggest that there is very little tendency for a leather to adhere to the lower roller 14.

The scraper brush 76 is located beneath a cover 77. This cover is positioned adjacent an upper extension 78 of the manual engagement portion 17. An opening 79 is formed between the upper extension 78 and the manual engagement portion 17. Thus, the upper extension 78, the cover 77 and to some extent the upper roller 13 cooperate to form a carrying handle 81 for the device as a whole, with the opening 79 providing a space for the thumb of the user.

The location of the handle 81 above and behind the centre of gravity of the device as a whole means that when the device is carried, it tilts in such a way that the suction device 18 is inclined to the vertical. This means that when the device is offered to a vehicle window, it will be at an appropriate orientation.

Thus, the present invention provides a portable wringer that can be firmly and reliably attached to a vehicle window and which enables a chamois leather, or a cloth to be wrung dry of liquid in a convenient and useful manner.

What is claimed is:

1. A portable wringer for removing liquid from a wet leather, cloth or piece of fabric, comprising a support structure; a pair of rollers rotatably mounted on the support structure; means for urging the rollers together towards a position in which the surfaces of the rollers would make mutual contact along their respective lengths; means for rotating at least one of the rollers; and a suction means operably coupled to the support structure, the suction means being arranged to adhere to a smooth surface and comprising a flexible disc having a central portion which is movable rearwardly from the plane of the disc in a direction towards the rollers by means of a cam arrangement.

2. A wringer as claimed in claim 1, in which the camming action of the cam arrangement is activated by a lever movable in a plane generally parallel to the plane of the disc.

3. A wringer as claimed in claim 2, further comprising a liquid catchment means arranged to receive liquid expelled from the leather cloth or piece of fabric by the rollers, in which the lever swings in an arc above the level of the cam arrangement and liquid catchment means, in use.

4. A wringer as claimed in claim 2, in which the cam arrangement has a cover extending into the enclosure, the cover being arranged to deflect the leather upwards as it leaves the rollers in use.

5. A wringer as claimed claim 1, including a manual engagement area at a position opposite to the suction means.

6. A wringer as claimed in claim 5, in which the manual engagement area is positioned opposite the centre of the suction device.

7. A wringer as claimed in claim 1, in which the support structure includes a pair of side walls, a base and an end wall, and in which the end wall carries the suction means, the sidewalls and base extend rearwards from the end wall in a direction towards the rollers, and the rollers extend between the side walls at a position spaced from the end wall.

8. A wringer as claimed in claim 1, in which the pair of rollers are arranged to lie one above the other in use, and further comprising a crank handle operatively connected to the lower roller whereby the lower roller can be manually rotated, and a cover partly surrounding the upper roller.

9. A wringer as claimed in claim 8, in which the cover constitutes optionally together with the upper roller itself, a carrying handle for the wringer.

10. A wringer as claimed in claim 8 further comprising a manual engagement area positioned opposite the suction means, in which the manual engagement area is constituted by a transverse wall portion located below the level of the cover.

11. A wringer as claimed in claim 1, in which the rollers are cylindrical and are arranged with their axes in parallel.

12. A wringer as claimed in claim 1, in which the rollers are urged into mutual contact.

13. A wringer as claimed in claim 1, in which the rollers each comprise a rigid core coated with a layer of resilient material.

14. A wringer as claimed in claim 1, in which the rollers have spindles at each end, each spindle being supported in a bearing, the bearings being urged together by resilient means.

15. A wringer as claimed in claim 15, in which one of the rollers is operatively connected to a crank handle, whereby the roller can be manually rotated.

16. A wringer as claimed in claim 15, in which the pair of rollers are arranged to lie one above the other in use and the crank handle is operatively connected to the lower roller.

17. A wringer as claimed in claim 1, including liquid catchment means arranged to receive liquid expelled from the leather cloth or piece of fabric by the rollers and an enclosure arranged to receive the leather cloth or piece of fabric as it leaves the rollers, in use.

18. A wringer as claimed in claim 17, in which the liquid catchment means comprises a tray, the tray having one or more liquid discharge ports.

19. A wringer as claimed in claim 18, in which any discharge port is arranged to discharge the liquid in use in a direction away from the user.

20. A wringer as claimed in claim 17, in which the enclosure is located above the liquid catchment means.

21. A wringer as claimed in claim 20, in which the enclosure includes a deflector arranged to direct the leather cloth or piece of fabric upwards in use.

22. A wringer as claimed in claim 1, including a scraper located adjacent the upper and/or lower roller and arranged to lift a leather cloth or piece of fabric adhering to the surface of the respective roller.

23. A wringer as claimed in claim 22, in which the scraper is a brush.

24. A wringer as claimed in claim 1, in which the suction means comprises a single suction device.

25. A portable wringer for removing liquid from a wet leather, cloth or piece of fabric, comprising: a support structure; a pair of rollers rotatably mounted on the support structure; resilient members operably coupled to the rollers for urging the rollers together towards a position in which the surfaces of the rollers would make mutual contact along their respective lengths; a rotating assembly operably coupled to at least one of the rollers for rotating the roller; and a suction device operably coupled to the support structure and arranged to adhere to a smooth surface, the suction device comprising a flexible disc having a central portion which is movable rearwardly from the plane of the disc in a direction towards the rollers by means of a cam arrangement.

26. A wringer as claimed in claim 25, in which the support structure comprises a pair of side walls, a base and an end wall, and in which the end wall carries the suction device, the sidewalls and base extend rearwards from the end wall in a direction towards the rollers, and the rollers extend between the side walls at a position spaced from the end wall.

27. A wringer as claimed in claim 25, in which the pair of rollers are arranged to lie one above the other in use, the rollers having spindles at each end, each spindle being supported in a bearing, the bearings being urged together by the resilient members, and in which the rotating assembly comprises a crank handle operatively connected to the lower roller whereby the lower roller can be manually rotated, and a cover partly surrounding the upper roller.

28. A wringer as claimed in claim 25, including a liquid catchment device arranged to receive liquid expelled from the leather, cloth or piece of fabric by the rollers and an enclosure arranged to receive the leather, cloth or piece of fabric as it leaves the rollers, in use.

* * * * *